US009149121B2

(12) United States Patent
Hoffman et al.

(10) Patent No.: US 9,149,121 B2
(45) Date of Patent: Oct. 6, 2015

(54) GLIDING-RECLINING SEATING UNIT ACTUATED BY PUSHING ON THE ARMS

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 193 days.

(21) Appl. No.: 13/366,547

(22) Filed: Feb. 6, 2012

(65) Prior Publication Data

US 2013/0200659 A1 Aug. 8, 2013

(51) Int. Cl.

| | |
|---|---|
| ***A47C 1/031*** | (2006.01) |
| ***A47C 1/035*** | (2006.01) |
| ***A47C 3/03*** | (2006.01) |
| ***A47C 1/0355*** | (2013.01) |
| *A47C 3/025* | (2006.01) |
| *A47C 1/034* | (2006.01) |

(52) U.S. Cl.

CPC ..... *A47C 1/035* (2013.01); *A47C 1/0355* (2013.01); *A47C 3/03* (2013.01); *A47C 1/0342* (2013.01); *A47C 3/0255* (2013.01)

(58) Field of Classification Search

USPC ..... 297/85 R, 84, DIG. 7

See application file for complete search history.

(56) References Cited

U.S. PATENT DOCUMENTS

| | | | | |
|---|---|---|---|---|
| 4,352,523 | A * | 10/1982 | Holobaugh, Jr. | 297/85 L |
| 4,536,029 | A | 8/1985 | Rogers, Jr. | |
| 4,544,201 | A | 10/1985 | Rogers, Jr. | |
| 4,591,205 | A * | 5/1986 | James | 297/85 R |
| 5,704,686 | A * | 1/1998 | May | 297/281 |
| 7,021,711 | B1 * | 4/2006 | Hoffman et al. | 297/270.1 |
| 7,997,644 | B2 | 8/2011 | Hoffman et al. | |
| 8,616,627 | B2 * | 12/2013 | Murphy et al. | 297/85 L |
| 2003/0193219 | A1 * | 10/2003 | Garland | 297/84 |
| 2006/0061164 | A1 * | 3/2006 | Deans et al. | 297/259.3 |
| 2006/0290174 | A1 * | 12/2006 | Hoffman et al. | 297/84 |
| 2007/0063559 | A1 * | 3/2007 | Chouinard et al. | 297/281 |
| 2009/0243368 | A1 * | 10/2009 | LaPointe | 297/85 R |
| 2012/0112518 | A1 * | 5/2012 | Murphy et al. | 297/85 L |

* cited by examiner

*Primary Examiner* — David E Allred

(74) *Attorney, Agent, or Firm* — Myers Bigel Sibley & Sajovec, P.A.

(57) ABSTRACT

A gliding reclining seating unit includes: a base; a frame with opposed arms; a gliding mechanism attached to the frame and the base, the gliding mechanism configured to enable the frame to glide longitudinally relative to the base; a seat; a backrest; an ottoman; a reclining mechanism comprising a plurality of pivotally interconnected links and attached to the frame, seat, backrest and ottoman, the reclining mechanism being configured to move the seating unit between an upright position, an intermediate TV position, and (c) a fully reclined position; and a glide stop unit that prevents the frame from gliding rearwardly relative to the base when the seating unit is in the TV and fully reclined positions. The seating unit is actuated for movement from the upright position to the TV position via an occupant of the chair pushing on the arms of the frame.

12 Claims, 9 Drawing Sheets

GLIDING-RECLINING SEATING UNIT ACTUATED BY PUSHING ON THE ARMS

FIELD OF THE INVENTION

This invention relates generally to seating units, and relates more particularly to reclining seating units with rocking capability.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

In recent years, furniture designers have looked for alternatives to rocking chairs that can provide a similarly relaxing repetitive motion. One alternative has been the gliding chair, or "glider", which includes structure that enables the seat portion of the chair to "glide" forwardly and rearwardly relative to its base to mimic generally the rocking motion of a rocking chair. Often the gliding structure comprises a set of swing links (usually two at the front of the chair, and two at the rear) that are pivotally attached at their upper ends to the base and extend downwardly therefrom to attach to a structure, such as a mounting bracket, that is attached to the seat. In this configuration, the seat is suspended from the base and is free to swing forwardly and rearwardly in a double pendulum-type motion in response to a forwardly or rearwardly-directed force applied by a seated occupant. The gliding path of the chair is controlled by the configuration and mounting of the swing links. These chairs can be constructed to resemble traditional rocking chairs and thus are quite popular.

Reclining capability has been combined with gliding capability in a single unit to provide a chair that both reclines and glides. This chair includes a reclining mechanism that enables it to move between upright and one or more reclined positions, and further includes the aforementioned swing links attached between the base and the seat, armrests, or mechanism itself to enable the chair to glide. Examples of such chairs are illustrated and described in U.S. Pat. Nos. 4,536,029 and 4,544,201, both to Rogers, Jr., the disclosures of which are hereby incorporated herein by reference in their entireties. Other examples are shown in U.S. Pat. No. 7,997,644 to Hoffman et al. and co-pending and co-assigned U.S. patent application Ser. No. 12/941,303 to Murphy et al., the disclosures of each of which is hereby incorporated herein in its entirety.

Although they are already popular seating units, it may be desirable to provide additional functionality to glider-recliners.

SUMMARY OF THE INVENTION

As a first aspect, embodiments of the invention are directed to a gliding reclining seating unit. The seating unit comprises: a base; a frame with opposed arms; a gliding mechanism attached to the frame and the base, the gliding mechanism configured to enable the frame to glide longitudinally relative to the base; a seat; a backrest; an ottoman; a reclining mechanism comprising a plurality of pivotally interconnected links and attached to the frame, seat, backrest and ottoman, the reclining mechanism being configured to move the seating unit between (a) an upright position, in which the seat is generally horizontally disposed, the backrest is generally vertically disposed, and the ottoman is generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases; and a glide stop unit that prevents the frame from gliding rearwardly relative to the base when the seating unit is in the TV and fully reclined positions. The seating unit is actuated for movement from the upright position to the TV position via an occupant of the chair pushing on the arms of the frame.

As a second aspect, embodiments of the invention are directed to a gliding reclining seating unit, comprising: a base; a frame with opposed arms; a gliding mechanism attached to the frame and the base, the gliding mechanism configured to enable the frame to glide longitudinally relative to the base; a seat; a backrest; an ottoman; a reclining mechanism comprising a plurality of pivotally interconnected links and attached to the frame, seat, backrest and ottoman, the reclining mechanism being configured to move the seating unit between (a) an upright position, in which the seat is generally horizontally disposed, the backrest is generally vertically disposed, and the ottoman is generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases; and a glide stop unit that prevents the frame from gliding rearwardly relative to the base when the seating unit is in the TV and fully reclined positions. The seat moves rearwardly from the upright position to the TV position a sufficient distance that the weight of a seated occupant substantially prevents forward longitudinal movement of the frame relative to the base.

As a third aspect, embodiments of the invention are directed to a gliding reclining seating unit, comprising: a base; a frame with opposed arms, the lowermost portion of the arms being raised from the floor such that the seating unit is a high leg seating unit; a gliding mechanism attached to the frame and the base, the gliding mechanism configured to enable the frame to glide longitudinally relative to the base; a seat; a backrest; an ottoman; a reclining mechanism comprising a plurality of pivotally interconnected links and attached to the frame, seat, backrest and ottoman, the reclining mechanism being configured to move the seating unit between (a) an upright position, in which the seat is generally horizontally disposed, the backrest is generally vertically disposed, and the ottoman is generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases; and a glide stop unit that prevents the frame from gliding rearwardly relative to the base when the seating unit is in the TV and fully reclined positions. The seating unit is actuated for movement from the upright position to the TV position via an occupant of the chair pushing on the arms of the frame.

DETAILED DESCRIPTION OF EMBODIMENTS OF THE INVENTION

Figure 1:
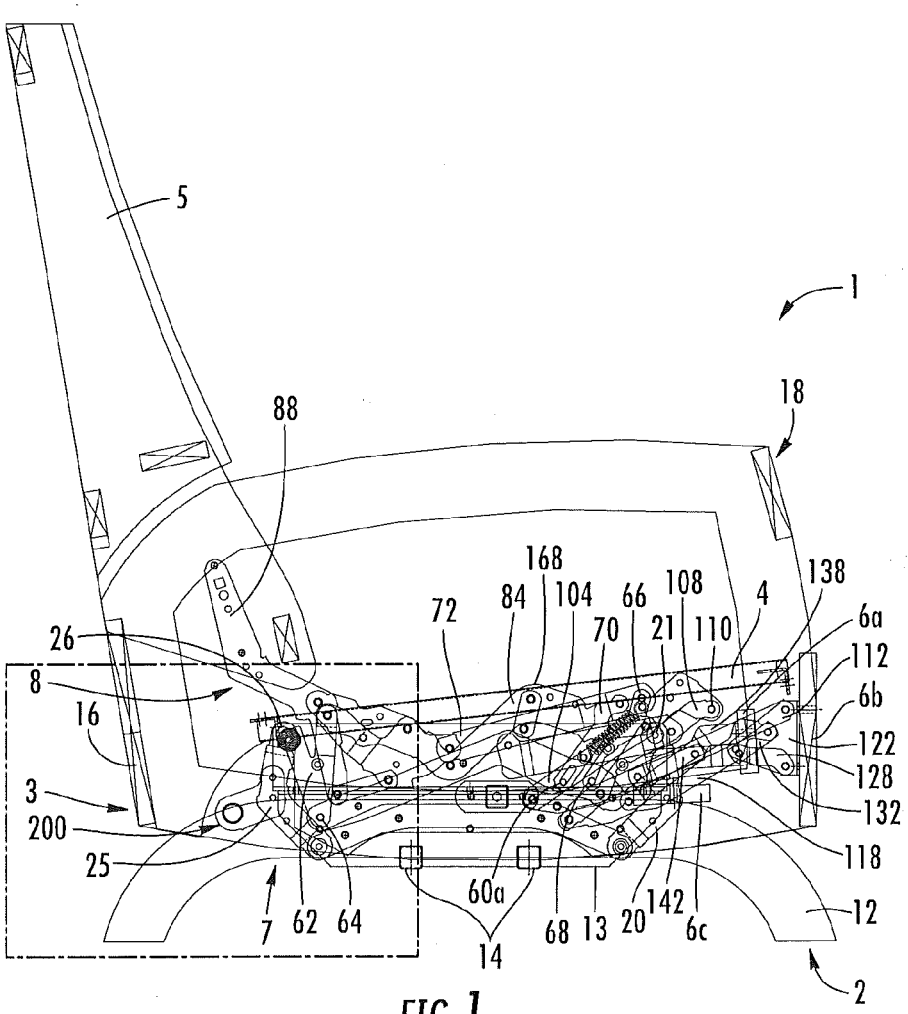
FIG. 1 is a cutaway side view of a high leg reclining chair according to embodiments of the present invention, wherein the chair is in its upright position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached"; "connected", "interconnected", "contacting", "coupled", "mounted" and the like can mean either direct or indirect attachment or contact between elements, unless stated otherwise.

In addition, some components of the seating units described herein (particularly mechanisms thereof) are illustrated herein as a series of pivotally interconnected links or members. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Referring now to the drawings, a chair, designated broadly at 10, is illustrated in FIGS. 1-6. The chair 1 includes a base 2, a frame 3, a seat 4, a backrest 5, ottomans 6*a*, 6*b*, 6*c*, a gliding mechanism 7 that interconnects the base 2 and the frame 3, and reclining mechanisms 8 that move the seat 4, the backrest 5 and the ottomans 6 relative to each other and to the frame 3 and base 2. These components are discussed in greater detail below.

The base 2 includes a pair of leg members 12 that rest on the underlying surface. A mounting bracket 13 is fixed to the upper surface of each leg member 12; cross-members 14 extend between and are fixed to the mounting brackets 13. A second mounting bracket 15 is mounted on top of each mounting bracket 13.

The frame 3 includes arms 18 that have outer panels 17 and inner panels 19. A cross-member 16 spans the rear portions of the arms 18, and spacers 16*a* span the front portions of the outer and inner panels 17, 19 of each arm, thereby creating a cavity 18*a* within each arm 18.

The gliding mechanism 7 includes pairs of front glide links 20 and rear glide links 25. Each front glide link 20 is pivotally mounted to the mounting bracket 15 at a pivot 21 and extends downwardly therefrom, and each rear glide link 25 is pivotally mounted to the mounting bracket at a pivot 26. At their lower ends, the front and rear glide links 20, 25 are pivotally mounted at pivots 27, 28 to a mounting bracket 31 that is mounted to the outer surface of the inner panel 19 of each arm 18, such that the glide links 20, 25 reside within the gap 18*a* of each arm 18.

The gliding mechanism 7 also includes a glide stop unit 200. The glide stop unit 200 comprises an extension member 202 that is mounted to the rear glide link 25 at a middle portion thereof and extends rearwardly therefrom within the gap 18*a* of the arm 18. A stop member 204 is mounted to and extends transversely between the rear ends of the extension member 202 on opposite sides of the chair 1. In this embodiment, the stop member 204 has a round cross-section, but other configurations may be employed.

The seat 4 comprises a rectangular frame formed of two longitudinal rails 34 and cross-members 35. A seat mounting panel 84 is mounted to the outer surface of each of the longitudinal rails 34.

The arms 18 of the chair 1 are raised off of the floor by the leg members 12 in a style known as "high leg", in which one or more of the legs of the chair 1 are exposed and clearly visible below the frame 3. Typically, the lower edge of each of the arms 18 is between about 2 and 5 inches from the floor.

Turning now to the reclining mechanism 8, each of the reclining mechanisms 8 is a mirror image of the other reclining mechanism about a vertical plane that extends from the front of the chair 1 to the rear centered between the arms 18.

In the interest of brevity, only one reclining mechanism 8 will be described herein, with the understanding that the discussion is equally applicable to the other reclining mechanism 8. Also, the reclining mechanism 8 will be described first with respect to the fully reclined position (FIG. 4) in order to illustrate more easily the interconnection of the various links thereof.

Figure 3:
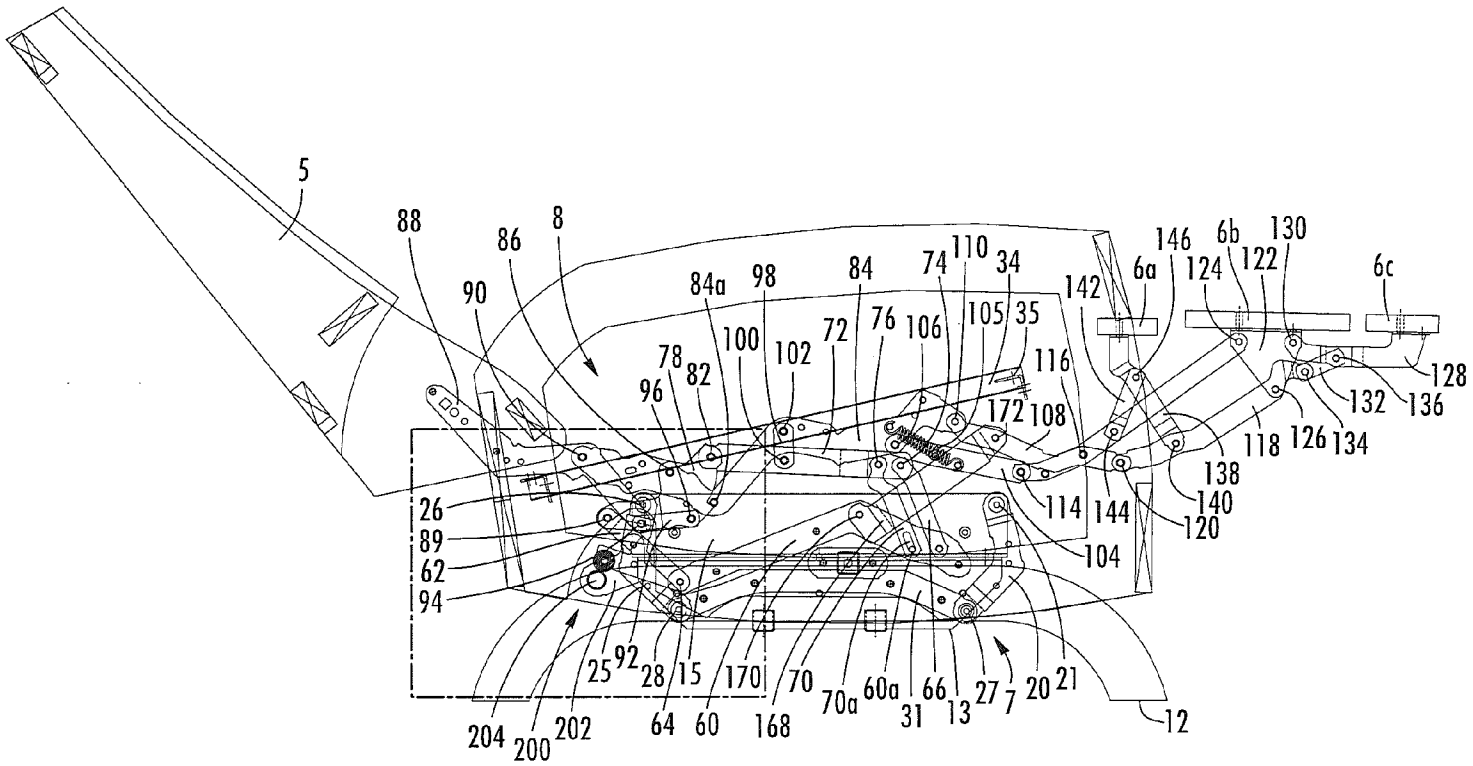
FIG. 3 is a cutaway side view of the chair of FIG. 1, wherein the chair is in its fully reclined position.
Figure 3A:
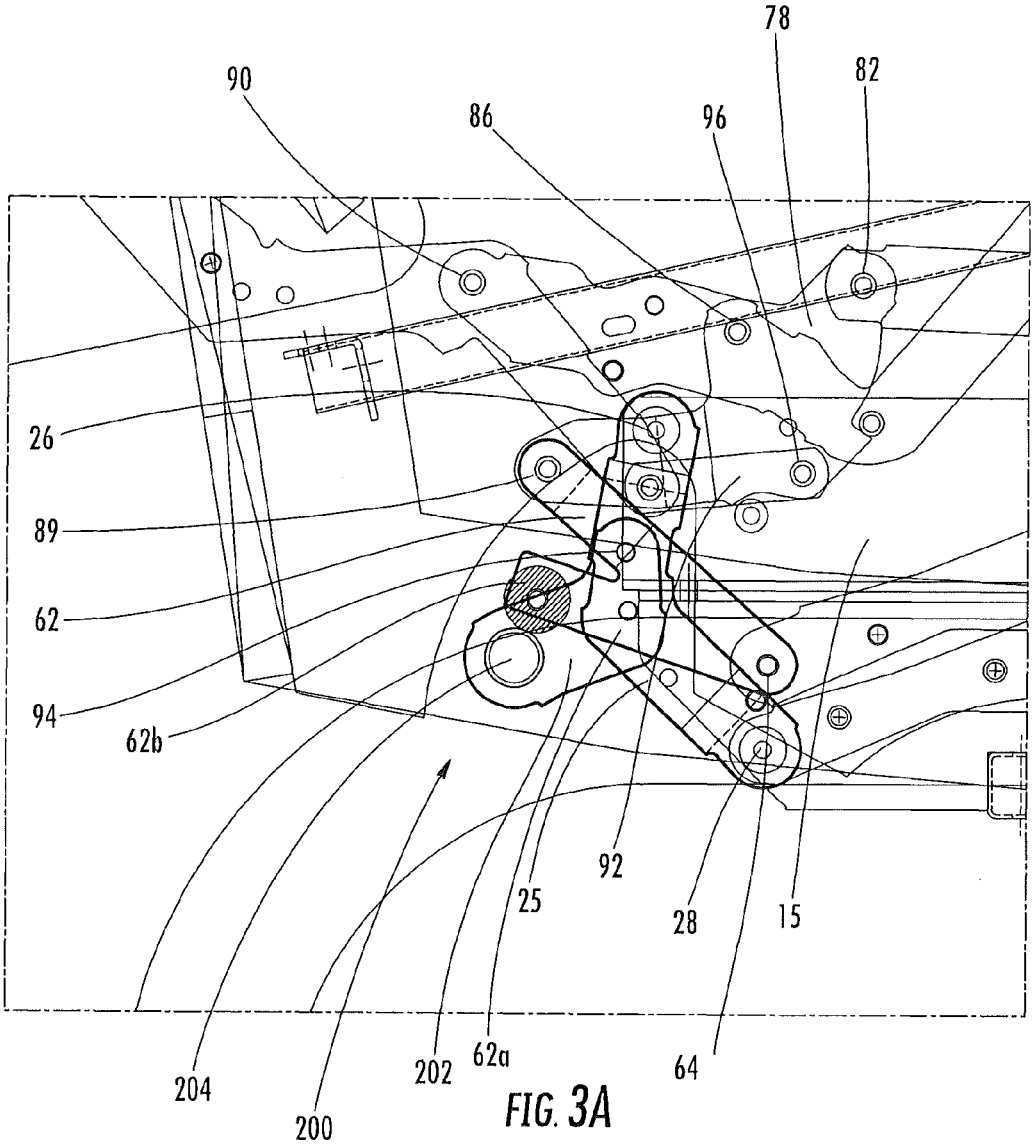
FIG. 3A is an enlarged view of the glide stop unit of the chair of FIG. 1 shown in the fully reclined position of FIG. 3.
Figure 4:
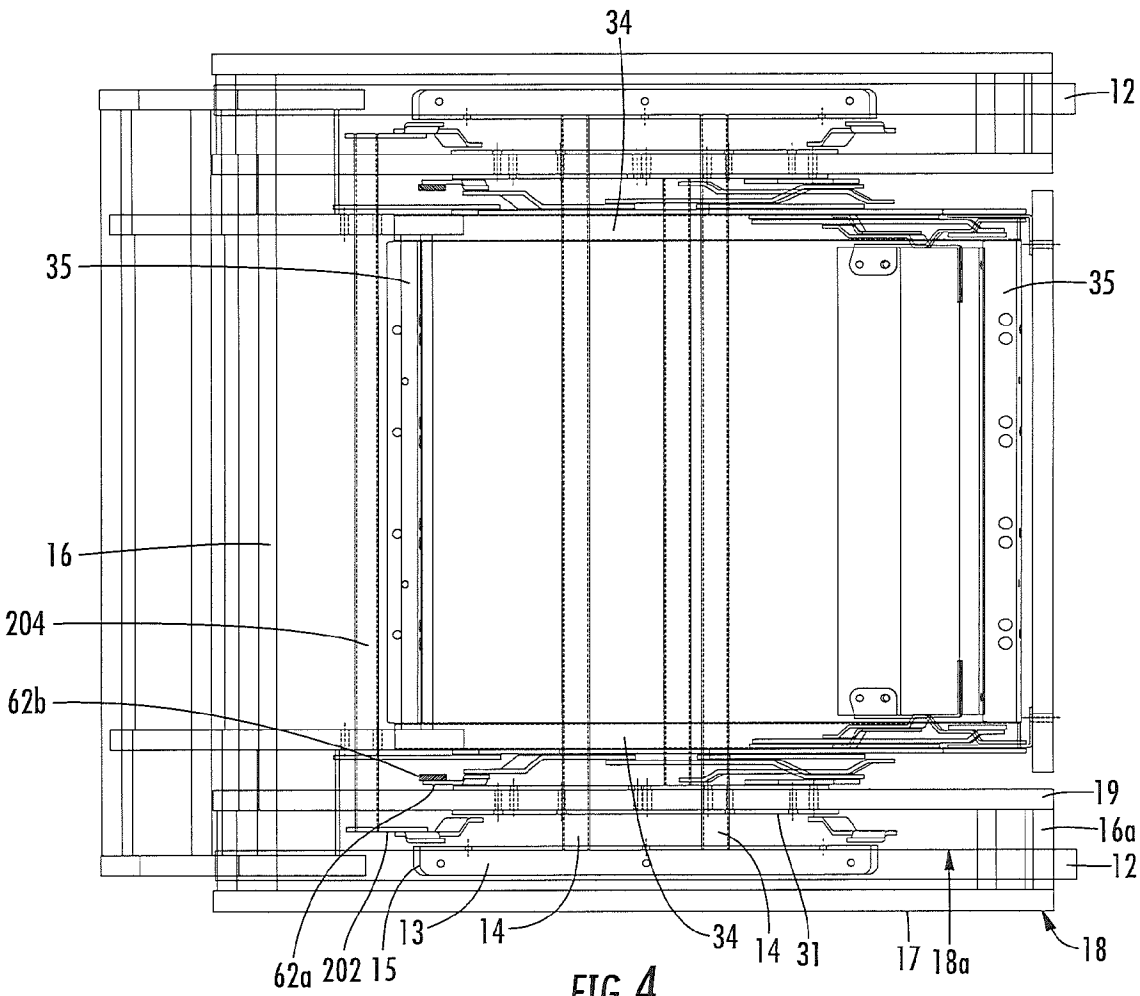
FIG. 4 is a cutaway top view of the chair of FIG. 1 shown in its upright position.
Figure 5:
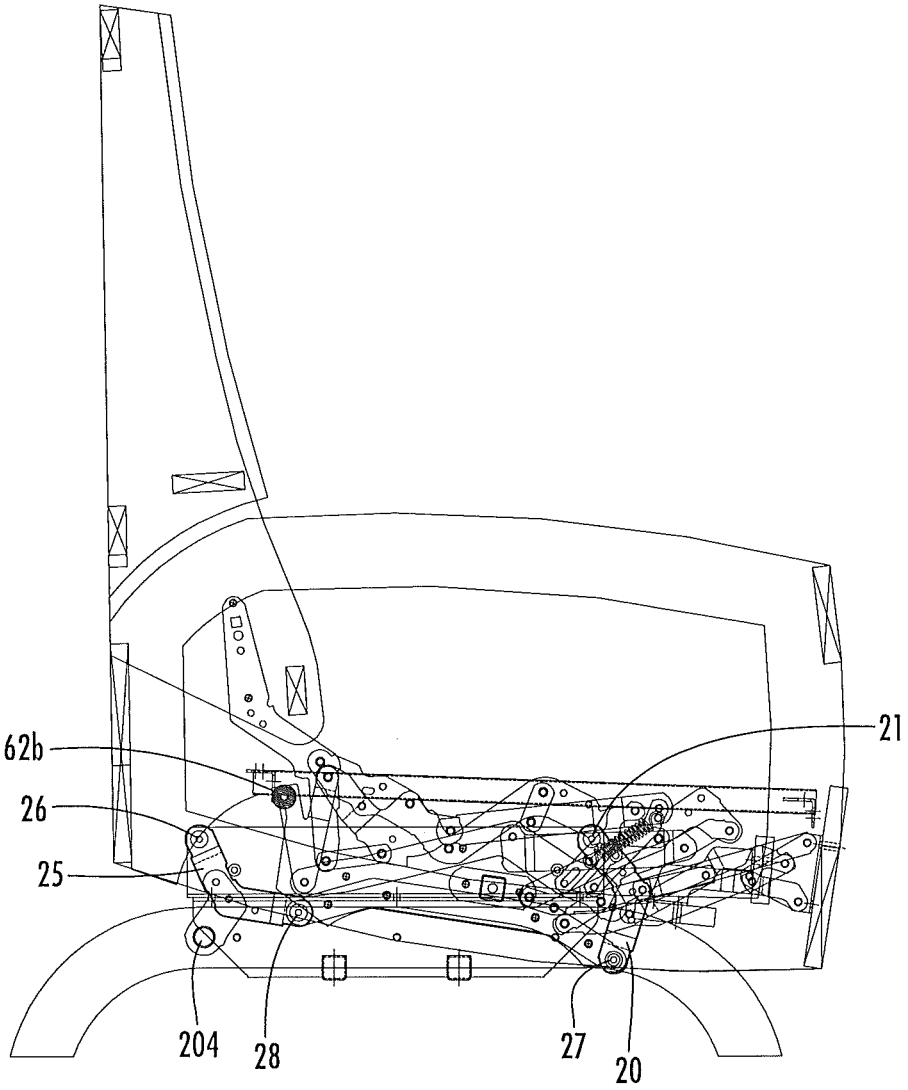
FIG. 5 is a cutaway side view of the chair of FIG. 1 shown in its upright position and glided to a forward position.
Figure 6:
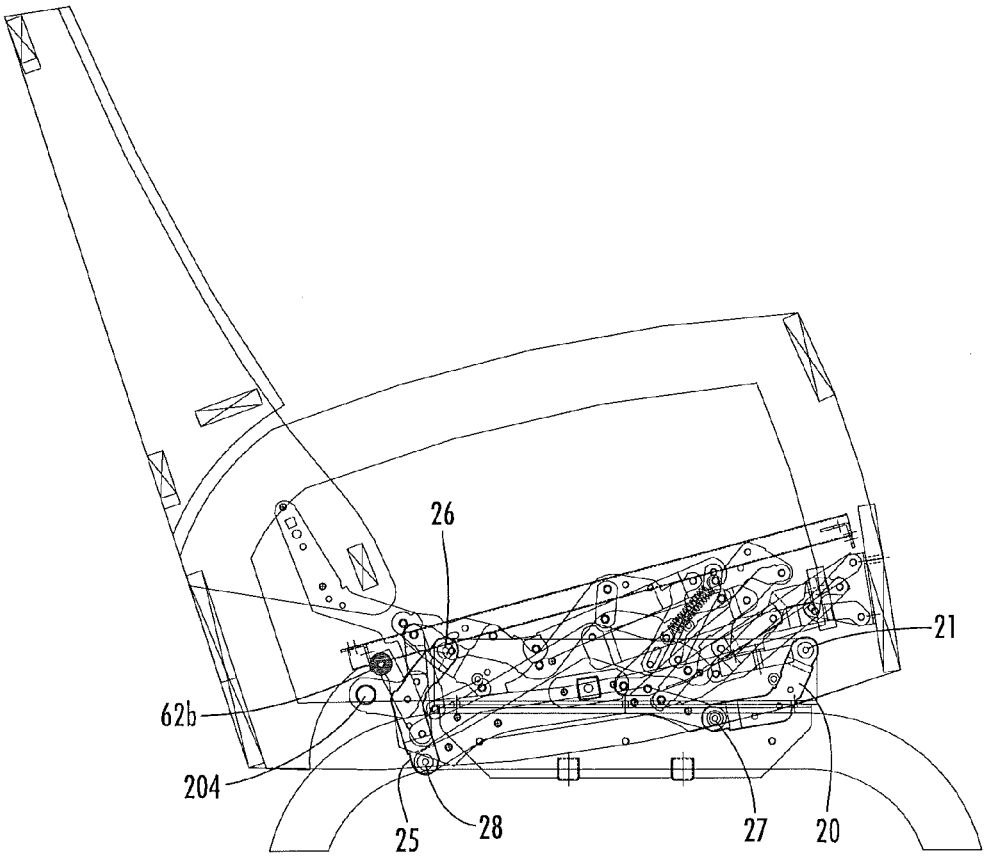
FIG. 6 is a cutaway side view of the chair of FIG. 1 shown in its upright position and glided to a rearward position.

Referring now to FIG. 3, the reclining mechanism 8 has an angled frame bracket 60 mounted to the inner surface of the inner arm panel 19. An angled rear swing link 62 is attached at its lower end to the frame bracket 60 at a pivot 64 and extends upwardly and rearwardly therefrom. A rear finger 62*a* extends upwardly and rearwardly from the pivot 64. A stop projection 62*b* extends transversely therefrom. A front swing link 66 is attached at its lower end to the frame bracket 60 at a pivot 68 and extends upwardly and slightly rearwardly therefrom. A sequencer link 70 is attached to the frame bracket 60 via slot 70*a* that receives a pin 60*a* on the frame bracket 60. The sequencer link 70 extends upwardly and rearwardly to attach to a connector link 72 at a pivot 76; the front swing link 66 also attaches to the connector link 72 at a pivot 74. The connector link 72 extends substantially rearwardly from the pivot 76 to a pivot 82 with a transition plate 78. The transition plate 78, which has three fingers, is attached by its middle finger to the seat panel 84 at a pivot 86, and is also attached at its rear finger with the upper end of the rear swing link 62 at a pivot 89. A control link 98 is attached to the seat panel 84 at a pivot 102 and to the connector link 72 at a pivot 100.

Still referring to FIG. 3, a tripartite backpost 88 is fixed to the backrest 5 and extends downwardly and forwardly therefrom. At one of its interior vertices, the backpost 88 is attached to the seat panel 84 at a pivot 90. A drive link 92 is attached to the lower, forward end of the backpost 88 at a pivot 94 and extends forwardly therefrom to a pivot 96 with the lower portion of the transition plate 78.

Referring still to FIG. 3, a rear ottoman drive link 104 is attached at a pivot 106 to the seat panel 84 and extends fowardly therefrom. A spring 105 extends between the rear ottoman drive link 104 and the seat panel 84. A front ottoman drive link 108 is attached at a pivot 110 to the seat panel 84 at a pivot that is positioned forwardly and upwardly from the pivot 106. A rear ottoman extension link 112 is attached to the forward end of the rear ottoman drive link 104 at a pivot 114 and extends forwardly and upwardly therefrom; the rear ottoman extension link 112 is also attached to an intermediate section of the front ottoman drive link 108 at a pivot 116. A front ottoman extension link 118 is attached at its rear end to the front end of the front ottoman drive link 108 at a pivot 120 and extends forwardly and upwardly therefrom generally parallel with the rear ottoman drive link 112. A main ottoman bracket 122, to which the main ottoman 6*b* is mounted, is attached to the forward ends of the rear ottoman drive link 112 and the front ottoman drive link 118 at, respectively, pivots 124 and 126.

Referring once again to FIG. 3, a front ottoman bracket 128 is attached to the main ottoman bracket 122 at a pivot 130 and extends forwardly therefrom. The front ottoman 6*c* is mounted to the forward end of the front ottoman bracket 128. A control link 132 extends between a pivot 134 with the front ottoman extension link 118 and a pivot 136 with the front ottoman bracket 128. A rear ottoman bracket 138 is attached to the front ottoman extension link 118 at a pivot 140 and extends upwardly and rearwardly to support the rear ottoman 6*a* mounted thereon. A bracing link 142 extends between a pivot 144 with the rear ottoman extension link 112 and a pivot 146 with the rear ottoman bracket 138.

A drive link 168 is attached to the front ottoman drive link 108 at a pivot 172, and extends rearwardly therefrom to a pivot 170 with the frame mounting bracket 60.

Operation of the chair typically begins in the upright position (FIG. 1). In the upright position, the ottomans 6*a*, 6*b*, 6*c* are all folded beneath the seat 4, with the main ottoman 6*b* positioned below the front of the seat 4 and vertically disposed, the rear ottoman 6*a* behind the main ottoman 6*b* and vertically disposed, and the front ottoman 6*c* horizontally disposed and facing the underlying surface. The links comprising the portion of the reclining mechanism 8 that extends the ottomans (i.e., the front and rear ottoman drive links 108, 104, the front and rear ottoman extension links 118, 112, the front, main and rear ottoman brackets 128, 122, 138, the control link 132, and the bracing link 142) are folded beneath the seat 4 as a pantographic linkage. The seat 4 is disposed above the base 2 and typically has a pitch angle of between about 5 and 8 degrees relative to horizontal, and the backrest 5 has a first backrest angle $\alpha$ of between about 60 and 80 degrees relative to horizontal. The reclining mechanism 8 is maintained in place by tension in the spring 105, which urges the reclining mechanism 8 toward the upright position.

In the upright position, the reclining mechanism 8 is folded into a relatively small package below the seat 4 and above the lower edges of the arms 18. This is done in order to hide the reclining mechanism 8 from an observer positioned to the side of the chair 1. The height dimension of the reclining mechanism 8 in the upright position (from the lowermost portion of the mechanism 8 to the seat 4) is between about 5 and 8 inches; this dimension is smaller than that of a typical reclining mechanism because of the high-leg style of the chair 1.

The chair 1 is free to glide along a longitudinal path defined by the front and rear glide links 20, 25 with the chair 1 in the upright position (see FIGS. 1, 5 and 6), which show forward and rearward gliding motion of the chair 1). The base 2 is stationary, and the glide links 20, 25 pivot about the pivots 21, 26 respectively, which causes the frame 3, and in turn the seat 4, the backrest 5, and the ottomans 6*a*, 6*b*, 6*c* to glide relative to the base 2. The components of the glide stop unit 200 are positioned such that the stop member 204 is well rearward of the rear finger 62*a* of the rear swing link 62, which enables the frame 3, seat 4, backrest 5, and ottomans 6*a*, 6*b*, 6*c* to glide fore and aft relative to the base 2 due to pivoting of the glide links 20, 25 about the pivots 21, 26 (see FIGS. 1A, 5 and 6).

To move the chair 1 to the TV position of FIG. 3, the occupant of the chair 1 pushes forwardly on the arms 18, which action forces the occupant's back rearwardly into the backrest 5. Forcing the backrest 5 and seat 4 rearwardly relative to the base 2 draws the seat 4 and seat panel 84 rearwardly; this movement is largely controlled by the rear swing link 62, the front swing link 66, and the sequencer link 70. Rearward movement of the seat 4 also forces the backrest 5 rearwardly relative to the frame 3 and rotates the backrest 5 very slightly counterclockwise. However, the backrest 5 substantially retains the first backrest angle between it and the seat 4 observed in the upright position of FIG. 2. In addition, rearward movement of the seat 4 draws the transition plate 78 rearward. This movement rotates the rear swing link 62 counterclockwise about the pivot 64 and draws the connecting link 72 rearwardly. As a result, the front swing link 66 and the sequencer link 70 rotate counterclockwise about their respective pivots 68, 60*a* (the sequencer link 70 also rises slightly relative to the pin 60*a* in its slot 70*a*, such that the pin 60*a* is in the center of the slot 70*a*).

Figure 1A:
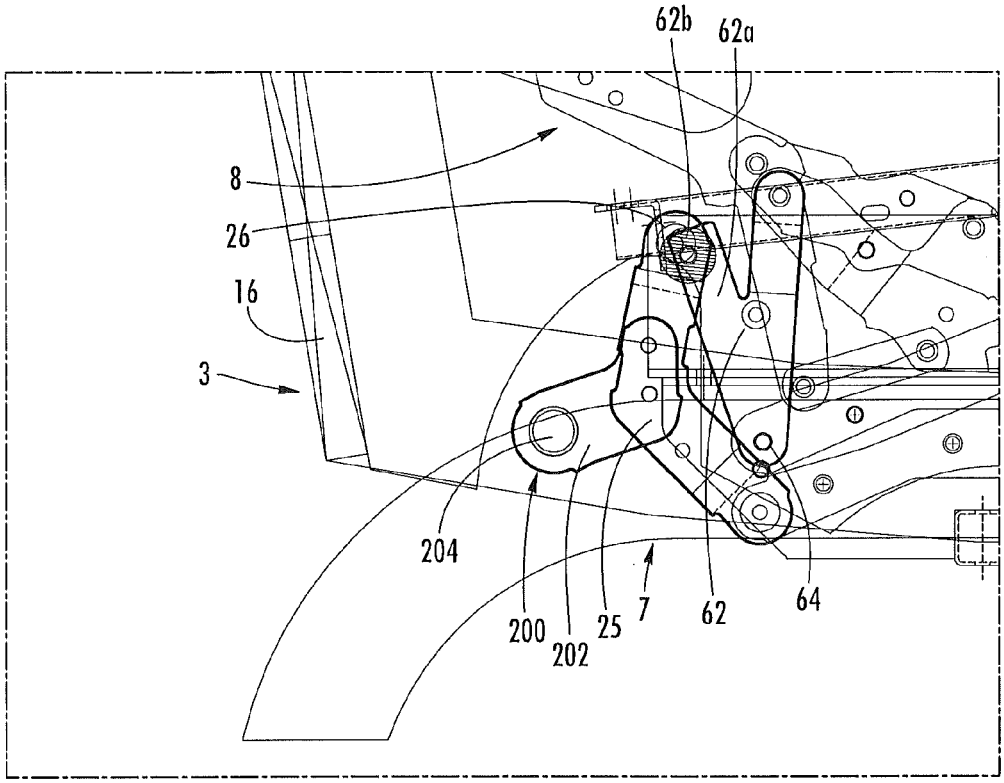
FIG. 1A is an enlarged view of the glide stop unit of the chair of FIG. 1.
Figure 2:
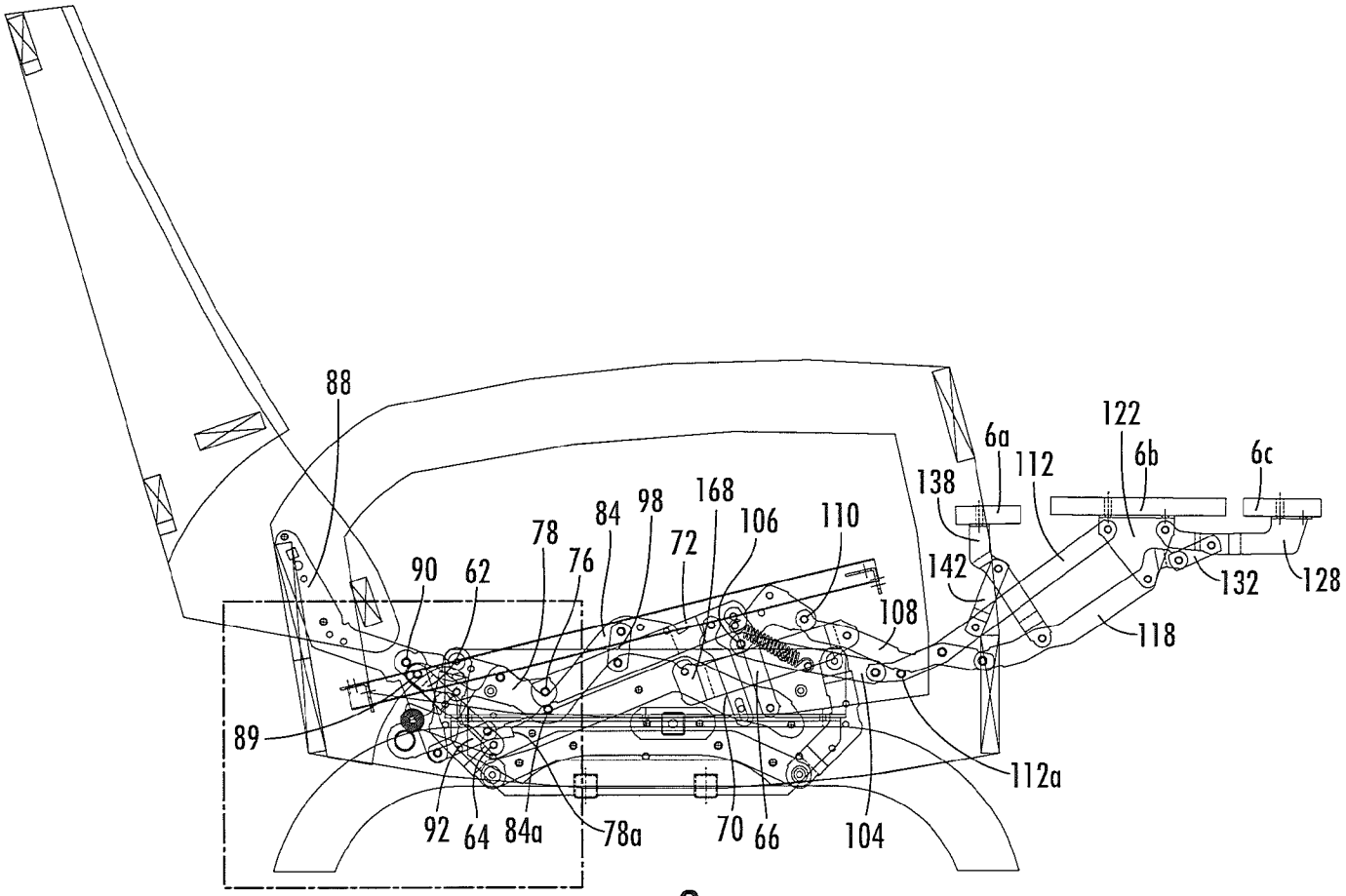
FIG. 2 is a cutaway side view of the chair of FIG. 1, wherein the chair is in its TV position.
Figure 2A:
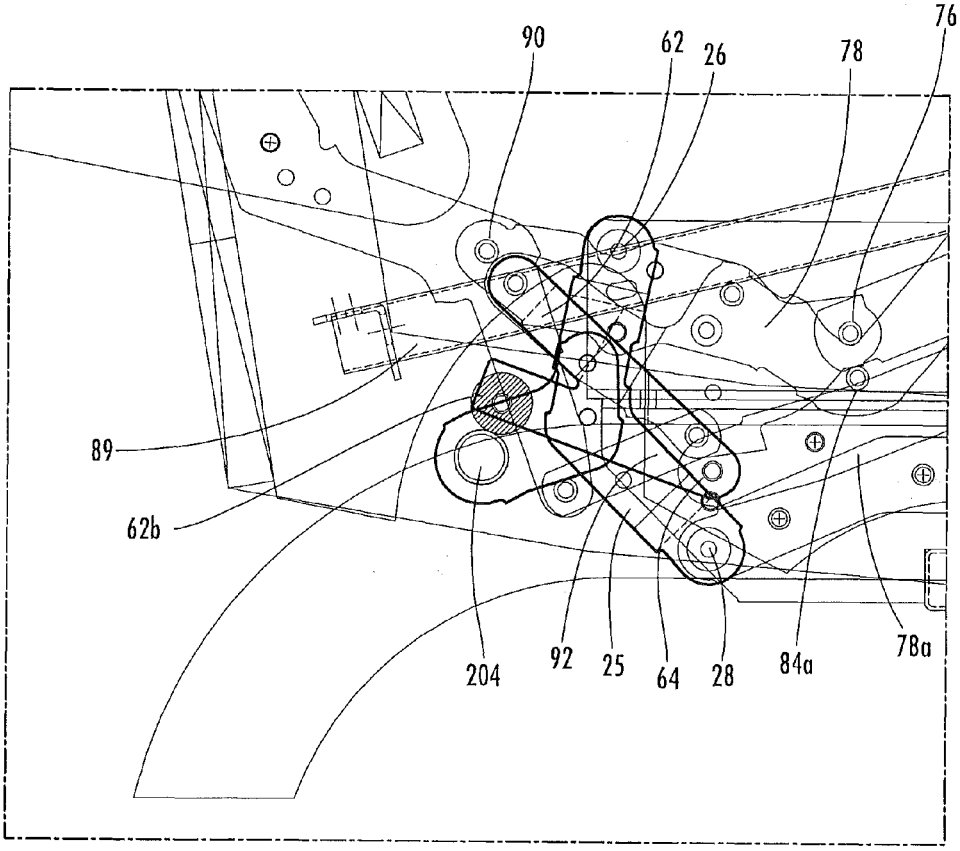
FIG. 2A is an enlarged view of the glide stop unit of the chair of FIG. 1 shown in the TV position of FIG. 2.

As can be seen in FIGS. 1A and 2A, the rotation of the rear swing link 62 also moves the rear finger 62*a* rearwardly and downwardly relative to the base 2. As such, the rear finger 62*a* moves to a position in which the rear surface of the stop projection 62*b* contacts the front surface of the stop member 204 of the glide stop unit 200 (see FIG. 2A). Consequently, the backrest 5, the seat 4, the frame 3 and the ottomans 6*a*, 6*b*, 6*c* are prevented from gliding motion rearward relative to the base 2.

Also, the rearward movement of the seat 4 relative to the base 2 moves the weight of the occupant of the chair 1 rearwardly. This rearward movement is typically between about 2.5 and 4.5 inches, and in particular between about 3 and 4 inches. Although there is not a structural component of the glide stop mechanism 200 that prevents the seat 4 from gliding forward relative to the base 2, the weight of the occupant is positioned sufficiently rearward that, absent the occupant taking a posture in which he leans forward to the extreme, the seat 4 does not glide forwardly relative to the base 2. In some embodiments, the center of the occupant's weight is positioned rearward of the pivot 28 between the rear glide link 25 and the frame bracket 60. Thus, with an occupant in the TV position the seat 4, the frame 3, the backrest 5 and the ottomans 6*a*, 6*b*, 6*c* are effectively prevented from gliding motion relative to the base 2.

Further, as the seat 4 moves rearwardly, the drive link 168 rotates only slightly, with the net effect that the front ottoman drive link 108 rotates counterclockwise considerably about the pivot 110. This action also extends the front and rear ottoman extension links 118, 112, which in turn rotates the rear ottoman link 104 counterclockwise about the pivot 106. Once rotation of the rear ottoman drive link 104 causes the axis defined by the spring 105 to pass the pivot 106, the spring 105 then urges the rear ottoman drive link 104 toward the TV position. Relative separation of the front and rear ottoman extension links 118, 112 also rotates the main ottoman bracket 122 and the main ottoman 6*b* to a generally horizontal disposition in front of the seat 4. Extension of the front ottoman extension link 118 and rotation of the main ottoman bracket 122 also draws forward and inverts the front ottoman bracket 128 and the front ottoman 6*c*. Extension and separation of the front and rear ottoman extension links 118, 112 also forces the rear ottoman bracket 138 and the rear ottoman 6*a* upwardly and rotates the rear ottoman bracket 138 about the pivot 140. Extension of the ottomans 6*a*, 6*b*, 6*c* ceases when the lower edge of the front ottoman drive link 108 strikes a stop pin 112*a* on the rear ottoman extension link 112.

To move the chair 10 to the fully reclined position of FIG. 3, the occupant again pushes forwardly on the arms 18, which forces the occupant's back into the backrest 5. This action forces the backpost 88 and the backrest 5 to rotate counterclockwise about the pivot 90 and move to a reclined position relative to the seat 4. Rotation of the backpost 88 drives the drive link 92 forwardly, which in turn causes the transition plate 78 to rotate counterclockwise about the pivot 89. Rotation of the transition plate 78 drives the seat panel 84 upwardly. As the seat panel 84 rises, through the control link 98 it pulls the connecting link 72 upwardly and rotates it clockwise about the pivot 76. Rotation ceases when an edge 78*a* of the transition plate 78 contacts a pin 84*a* on the seat panel 84. In this position, the backrest 5 typically reclines at a second backrest angle $\alpha'$ of between about 45 and 65 degrees relative to horizontal.

Also, although the seat 4 rises, the rear finger 62*a* and the stop projection 62*b* remain in a position to contact the stop member 204 of the glide stop unit 200. Consequently, the frame 3, seat 4, backrest 5 and ottomans 6*a*, 6*b*, 6*c* are still prevented from gliding rearwardly relative to the base 2, and the rearward position of the seat 4 inhibits forward gliding motion absent the occupant taking an extreme forward-leaning posture.

The chair 1 can be returned to the TV and/or upright position by the occupant pushing downwardly with his feet on one or more of the ottomans 6*a*, 6*b*, 6*c* or by pulling rearwardly on the arms 18. The links of the reclining mechanism 8 will reverse the various movements described above.

Those skilled in this art will recognize that the reclining mechanism 8 may be employed with a variety of reclining seating units, including sofas and sectional units, including those that have fewer, or even no, ottomans or arms. Also, the reclining mechanism may be employed with seating units that actuate in different ways, such as handles, release levers, and the like.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A gliding reclining seating unit, comprising:

a base;

a frame with opposed arms;

a gliding mechanism attached to the frame and the base, the gliding mechanism configured to enable the frame to glide longitudinally relative to the base;

a seat;

a backrest;

an ottoman;

a reclining mechanism comprising a plurality of pivotally interconnected links and attached to the frame, seat, backrest and ottoman, the reclining mechanism being configured to move the seating unit between (a) an upright position, in which the seat is generally horizontally disposed, the backrest is generally vertically disposed, and the ottoman is generally vertically disposed and positioned below the seat, (b) an intermediate TV position, in which the ottoman is generally horizontally disposed in front of the seat and the backrest and the seat substantially maintain the same relative relationship as they have in the upright position but move rearwardly relative to the frame, and (c) a fully reclined position, in which the angle between the backrest and the seat increases; and a glide stop unit that prevents the frame from gliding rearwardly relative to the base when the seating unit is in the TV and fully reclined positions;

wherein the seating unit is adapted to be actuated for movement from the upright position to the TV position solely via a seated occupant of the chair applying a rearward force to the backrest with the occupant's back by pushing directly on the arms of the frame;

wherein the gliding mechanism comprises a rear glide link pivotally interconnected to the base and to the frame and a front glide link pivotally interconnected to the base and to the frame; and wherein the glide stop unit comprises a stop member attached to the rear glide link; and wherein the reclining mechanism includes a rear swing link pivotally attached to the frame and a transition plate pivotally attached to the rear swing link and to the seat; and wherein, in moving from the upright position to the TV position, the rear swing link rotates relative to the frame so that an upper end of the rear swing link engages the stop member of the rear glide link to prevent rearward gliding movement of the frame and seat relative to the base.

2. The seating unit defined in claim 1, wherein the front and rear glide links reside in cavities within the arms of the frame.

3. The seating unit defined in claim 1, wherein the rear swing link includes a rear finger and a projection attached to the rear finger, the projection engaging the stop member of the glide stop unit when the seating unit is in the TV and fully reclined positions.

4. The seating unit defined in claim 1, wherein the seating unit is a high-leg seating unit.

5. The seating unit defined in claim 1, wherein the seat moves rearwardly relative to the frame between about 2.5 and 4.5 inches in moving from the upright to the TV position.

6. A gliding reclining seating unit, comprising:

a base;

a frame with opposed arms;

a gliding mechanism attached to the frame and the base, the gliding mechanism configured to enable the frame to glide longitudinally relative to the base;

a seat;

a backrest;

an ottoman;

a reclining mechanism comprising a plurality of pivotally interconnected links and attached to the frame, seat, backrest and ottoman, the reclining mechanism being configured to move the seating unit between (a) an upright position, in which the seat is generally horizontally disposed, the backrest is generally vertically disposed, and the ottoman is generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases; and a glide stop unit that engages the gliding mechanism and thereby prevents the frame from gliding rearwardly relative to the base when the seating unit is in the TV and fully reclined positions, wherein engagement of the gliding mechanism by the glide stop unit does not prevent the frame from gliding forwardly relative to the base when the seating unit is in the TV and fully reclined positions;

wherein the reclining mechanism is adapted to control movement of the seat, ottoman and backrest relative to the arm frame such that the seat moves rearwardly relative to the base from the upright position to the TV position a sufficient distance that the weight of a seated occupant substantially prevents forward longitudinal movement of the frame relative to the base;

wherein the gliding mechanism comprises a rear glide link pivotally interconnected to the base and to the frame and a front glide link pivotally interconnected to the base and to the frame; and wherein the glide stop unit comprises a stop member attached to the rear glide link; and wherein the reclining mechanism includes a rear swing link pivotally attached to the frame and a transition plate that is pivotally attached to the rear swing link and to the seat; and wherein, in moving from the upright position to the TV position, the rear swing link rotates relative to the frame so that an upper end of the rear swing link engages the stop member of the rear glide link to prevent rearward gliding movement of the frame and seat relative to the base.

7. The seating unit defined in claim 6, wherein the front and rear glide links reside in cavities within the arms of the frame.

8. The seating unit defined in claim 6, wherein the rear swing link includes a rear finger and a projection attached to the rear finger, the projection engaging the stop member of the glide stop unit when the seating unit is in the TV and fully reclined positions.

9. The seating unit defined in claim 6, wherein the seating unit is actuated for movement from the upright position to the TV position via an occupant of the chair pushing directly on the arms of the frame.

10. The seating unit defined in claim 6, wherein the seating unit is a high-leg seating unit.

11. The seating unit defined in claim 6, wherein the seat moves rearwardly relative to the frame between about 2.5 and 4.5 inches in moving from the upright to the TV position.

12. A gliding reclining seating unit, comprising:

a base;

a frame with opposed arms;

a gliding mechanism attached to the frame and the base, the gliding mechanism configured to enable the frame to glide longitudinally relative to the base;

a seat;

a backrest;

an ottoman;

a reclining mechanism comprising a plurality of pivotally interconnected links and attached to the frame, seat, backrest and ottoman, the reclining mechanism being configured to move the seating unit between (a) an upright position, in which the seat is generally horizontally disposed, the backrest is generally vertically disposed, and the ottoman is generally vertically disposed and positioned below the seat, (b) an intermediate TV position, in which the ottoman is generally horizontally disposed in front of the seat and the backrest and the seat substantially maintain the same relative relationship as they have in the upright position but move rearwardly relative to the frame, and (c) a fully reclined position, in which the angle between the backrest and the seat increases; and a glide stop unit that prevents the frame from gliding rearwardly relative to the base when the seating unit is in the TV and fully reclined positions;

wherein the gliding mechanism comprises a rear glide link pivotally interconnected to the base and to the frame and a front glide link pivotally interconnected to the base and to the frame; and wherein the glide stop unit comprises a stop member attached to the rear glide link; and wherein the reclining mechanism includes a rear swing link pivotally attached to the frame and a transition plate that is pivotally attached to the rear swing link and to the seat; and wherein, in moving from the upright position to the TV position, the rear swing link rotates relative to the frame so that an upper end of the rear swing link engages the stop member of the rear glide link to prevent rearward gliding movement of the frame and seat relative to the base.

* * * * *